US007470108B2

(12) United States Patent
Watanabe et al.

(10) Patent No.: US 7,470,108 B2
(45) Date of Patent: Dec. 30, 2008

(54) AXIAL FLOW FAN

(75) Inventors: Masanori Watanabe, Chiyoda (JP); Taku Iwase, Tsuchiura (JP); Shouichi Kawamata, Hitachi (JP); Osamu Sekiguchi, Tokyo (JP); Taro Tanno, Tokyo (JP)

(73) Assignee: Japan Servo Co., Ltd., Tokyo (JP)

( * ) Notice: Subject to any disclaimer, the term of this patent is extended or adjusted under 35 U.S.C. 154(b) by 438 days.

(21) Appl. No.: 11/109,717

(22) Filed: Apr. 20, 2005

(65) Prior Publication Data

US 2005/0232765 A1 Oct. 20, 2005

(30) Foreign Application Priority Data

Apr. 20, 2004 (JP) ..... 2004-123779

(51) Int. Cl.
*F04D 29/54* (2006.01)

(52) U.S. Cl. ..... 415/207; 415/119; 415/211.1; 415/211.2; 415/220; 415/222; 415/223; 62/296; 62/426; 62/441

(58) Field of Classification Search ..... 415/119, 415/207, 208.1, 208.2, 211.1, 211.2, 220, 415/222–223; 62/186, 404, 426, 441, 296; 361/695–697
See application file for complete search history.

(56) References Cited

U.S. PATENT DOCUMENTS

| | | | | |
|---|---|---|---|---|
| 3,425,236 | A * | 2/1969 | Streed et al. | 62/186 |
| 4,167,376 | A * | 9/1979 | Papst | 417/354 |
| 4,221,546 | A | 9/1980 | Papst et al. | |
| 4,734,015 | A * | 3/1988 | Wrobel | 415/207 |
| 5,342,173 | A * | 8/1994 | Vera | 416/169 A |
| 6,254,343 | B1 * | 7/2001 | Schmidt et al. | 415/222 |
| 6,572,333 | B2 * | 6/2003 | Fujinaka | 415/208.2 |
| 6,752,587 | B2 * | 6/2004 | Lin et al. | 415/220 |
| 7,025,570 | B2 * | 4/2006 | Jung et al. | 416/192 |
| 7,125,220 | B2 * | 10/2006 | Horng et al. | 415/119 |

FOREIGN PATENT DOCUMENTS

| | | |
|---|---|---|
| CN | 1335455 | 2/2002 |
| JP | 06-241045 | 8/1994 |
| JP | 2002-188599 | 7/2002 |
| JP | 2002-267319 | 9/2002 |

* cited by examiner

*Primary Examiner*—Christopher Verdier
(74) *Attorney, Agent, or Firm*—Antonelli, Terry, Stout & Kraus, LLP.

(57) ABSTRACT

In an axial flow fan, for reducing fluid noise and further reducing the noise by suppressing solid-conveyed noise (structure-borne noise) generated by the vibration of an electric motor or the like, the axial flow fan is equipped with a propeller, a motor for driving the propeller, and a venturi portion disposed on the outer circumference side of the propeller and provided on its inner circumferential side with a bellmouth through which an air flow generated by the revolution of the propeller passes, wherein the bellmouth has an intake portion whose diameter contracts in a curved shape in the direction of the air flow, a cylindrical portion having a cylindrical shape, and a discharge portion whose diameter slantingly expands in the direction of the air flow.

9 Claims, 10 Drawing Sheets

AXIAL FLOW FAN

BACKGROUND OF THE INVENTION

1. Field of the Invention

The present invention relates to an axial flow fan for use in electrical household appliances including refrigerators, various equipment for office automation and information technology (IT) items.

2. Description of the Related Art

For instance, axial flow fans for cooling purposes are used in many electrical household appliances including refrigerators, various equipment for office automation and IT items. Axial flow fans for use in these products are required to have large air flow capacities for reducing the calorific power and cost of the products in which they are to be installed. However, axial flow fans tend to increase in noise emission due to electromagnetic exciting force and propeller revolution along with an increase in air flow capacity. On the other hand, the demand for noise reduction is also increasingly keen reflecting the pursuit of more pleasant working or living environments. Against this background, many technological developments have been undertaken to meet low noise requirements.

Known technologies developed for low noise axial flow fans include, for instance, one of restraining turbulent noise by providing an air pocket on the outer circumferential part of the venturi portion and providing legs (spiders) which cross the trailing edge of the propeller at a certain angle (see JP-A-2002-188599 for instance), another of reducing fluid noise by shaping the inner circumference of the venturi portion like a bellmouth, expanding from the leeward side to the windward side (see JP-A-2002-267319 for instance), and still another of also reducing fluid noise by determining the opening angle on the discharge side of the venturi portion depending on the angle on the suction side (see JP-A-6-241045 for instance).

However, any of these examples of the related art is intended to reduce fluid noise generated by the revolution of the propeller, but is not intended to reduce solid-conveyed noise (structure-bone noise) generated by the vibration of the motor or the like. Therefore, in overall evaluation of an axial flow fan, there still is room for improvement in noise reduction.

BRIEF SUMMARY OF THE INVENTION

An object of the present invention is to provide an axial flow fan which is reduced in fluid noise and allows a further reduction in noise by cutting back the solid-conveyed noise (structure-borne noise) generated by the vibration of the motor.

In order to achieve the object stated above, according to the present invention, there is provided an axial flow fan comprising a propeller, an electric motor for driving the propeller, and a venturi portion disposed on the outer circumference side of the propeller and provided on the inner circumferential side of the venturi portion with a bellmouth through which an air flow generated by the revolution of the propeller passes, wherein the bellmouth has an intake portion whose diameter contracts in a curved shape in the direction of the air flow, a cylindrical portion having a cylindrical shape, and a discharge portion whose diameter slantingly expands in the direction of the air flow. With such a bellmouth structure, it is possible to restrain the fluid within the bellmouth from peeling off so as to reduce fluid noise, and to increase the rigidity of the bellmouth so as to raise the point of resonance above the order rotational frequency range in which the fan is used, resulting in an anti-resonance structure. Therefore, not only can fluid noise be reduced but also the solid-conveyed noise due to the vibration of the motor can be reduced, resulting in a further cutback on the overall noise level.

According to the invention, it is possible to reduce fluid noise and allow a further reduction in noise by cutting back the solid-conveyed (structure-borne) noise generated by the vibration of the motor.

Other object, features and advantages of the invention will become apparent from the following description of the embodiments of the invention taken in conjunction with the accompanying drawings.

DETAILED DESCRIPTION OF THE INVENTION

An axial flow fan, which is a preferred embodiment according to the present invention, will be described below with reference to the accompanying drawings.

Figure 1:
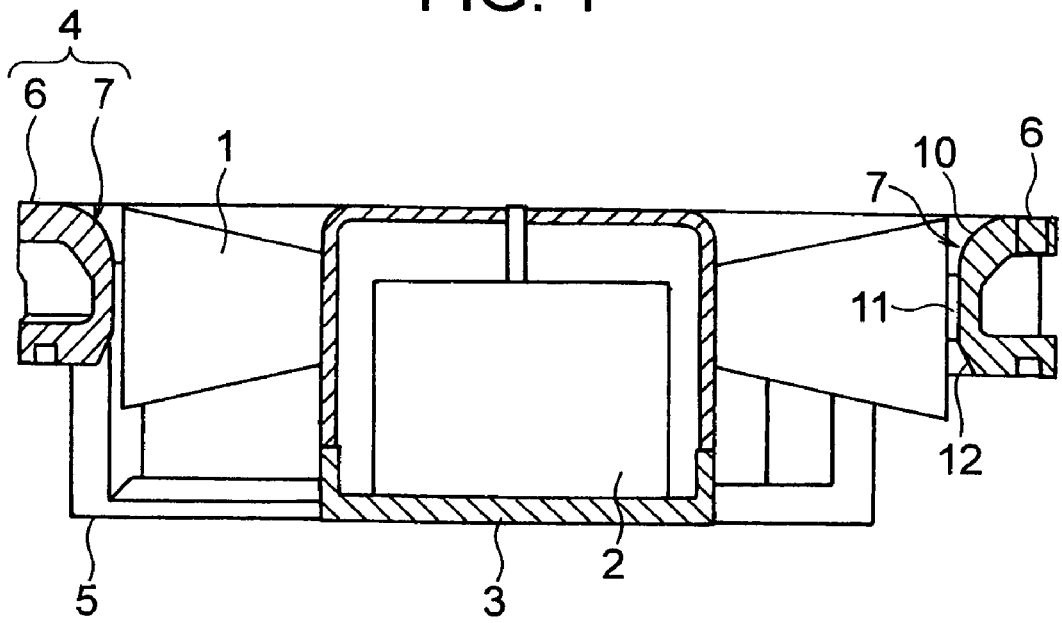
FIG. 1 is a section view showing an overall structure of an axial flow fan, which is a preferred embodiment according to the present invention.
Figure 2:
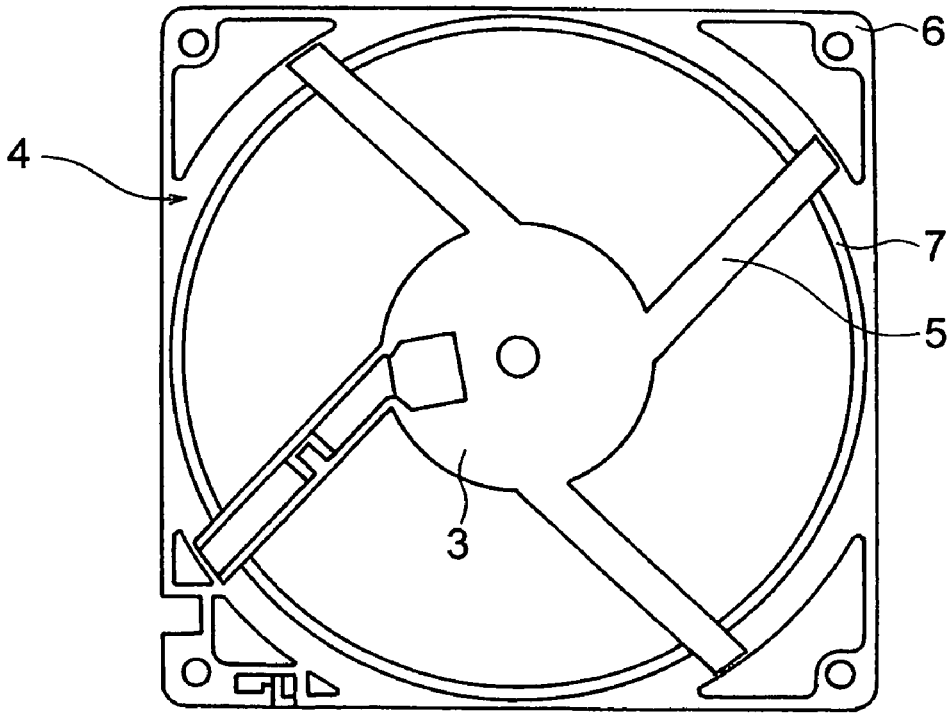
FIG. 2 is a plan view showing the overall structure of an axial flow fan, which is the preferred embodiment according to the invention.

FIG. 1 is a section view showing an overall structure of the axial flow fan embodying the invention and FIG. 2, a plan view of the same (as viewed from the discharge side (the lower part of FIG. 1)). As shown in these FIG. 1 and FIG. 2, the axial flow fan is provided with a propeller 1 which generates an air flow by rotating, a motor (electric motor) 2 for driving the propeller 1, a plate (motor supporting part) 3 supporting this motor 2, a venturi portion 4 disposed on the outer circumference side of the propeller 1 with a gap between the venturi portion and a tip of the propeller 1, and a plurality of (four in this embodiment) legs (spiders) 5 linking the plate 3 and the venturi portion 4. The motor 2 is integrally fitted onto the plate 3, and the propeller 1 is fitted to contain the motor 2 in it. The venturi portion 4 is composed of an outer frame 6 of which an outer configuration is substantially a square shape and a bellmouth 7 on the inner circumference side of which the propeller 1 is disposed and through which the air flow generated by the rotation of the propeller 1 passes. As shown in FIG. 1, the inner circumference side of the venturi portion 4 has a height which is smaller than a height of the outer circumference side of the propeller as measured between the lowermost and the uppermost portions of the propeller in a direction parallel to an axis of rotation of the motor 2. The parts of the legs (spiders) 5 on the venturi portion 4 side are joined to the outer frame 6.

The bellmouth 7 comprises an intake portion 10 whose diameter contracts in the curved shape in the direction of the air flow, a cylindrical portion 11 having a cylindrical shape of substantially the same diameter, and a discharge portion 12 which slantingly expands in the direction of the air flow at an angle of about 30°.

Figure 3:
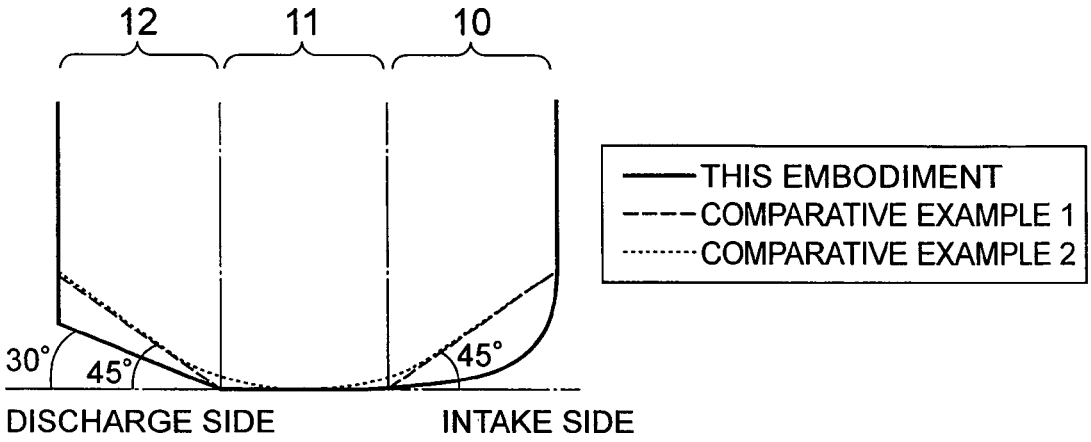
FIG. 3 comparatively illustrates the bellmouth shape of an axial flow fan embodying the invention and the bellmouth shapes of Comparative Example 1 and Comparative Example 2.

The effects provided by the above-described structure of the bellmouth 7 of the axial flow fan in the embodiment according to the invention will be described below in comparison with two comparative examples. FIG. 3 comparatively shows the bellmouth shapes of these two comparative examples and the bellmouth shape of the axial flow fan in the embodiment.

Referring to FIG. 3, the bellmouth of the axial flow fan of Comparative Example 1 has such a shape that both the intake portion and the discharge portion positioned on both sides of the cylindrical portion expand at an angle of about 45° each toward the intake side and the discharge side, the shape corresponding to that of the usual bellmouth of a conventional axial flow fan. The bellmouth of Comparative Example 2 has such a trumpet shape that the intake portion is expanded from the leeward side to the windward side and the discharge portion is also trumpet-shaped, expanding from the windward side to the leeward side to (in other words, the corners of the bellmouth of Comparative Example 1 are rounded here), again the shape corresponding to that of the usual bellmouth of a conventional structure, disclosed in the above JP-A-2002-267319.

First, the effects of this embodiment will be described in comparison with Comparative Example 1.

Figure 4:
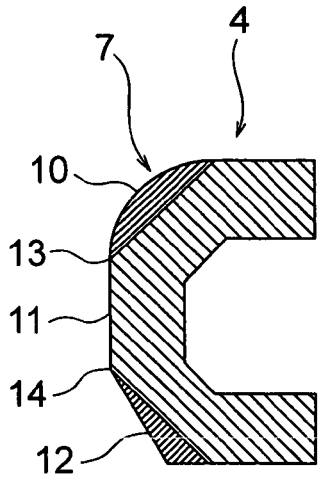
FIG. 4 is a sectional view comparatively illustrating the bellmouth shape of an axial flow fan embodying the invention and that of Comparative Example 1.

FIG. 4 is a sectional view comparatively illustrating the bellmouth shape of Comparative Example 1 and the shape of the bellmouth 7 of this fan embodiment. Since both the intake portion and the discharge portion of the bellmouth of Comparative Example 1 expand at an angle of 45° as shown in this FIG. 4, the use of the structure of the bellmouth 7 of this embodiment would expand the volume of the bellmouth by the finer hatched parts in the drawing. This can increase the rigidity of the venturi portion 4.

If the rigidity of the venturi portion is insufficient as in Comparative Example 1 for example, a phenomenon of resonance may be generated by the coincidence of the frequency (normal mode of vibration) of (and) the exciting force (by the electromagnetic exciting force) of the motor and a natural frequency of the venturi portion in the rotational frequency range in which the fan is used. In this embodiment of the invention, since the rigidity of the venturi portion 4 can be increased, this phenomenon of resonance mode can be avoided. This point will be described below.

Figure 5:
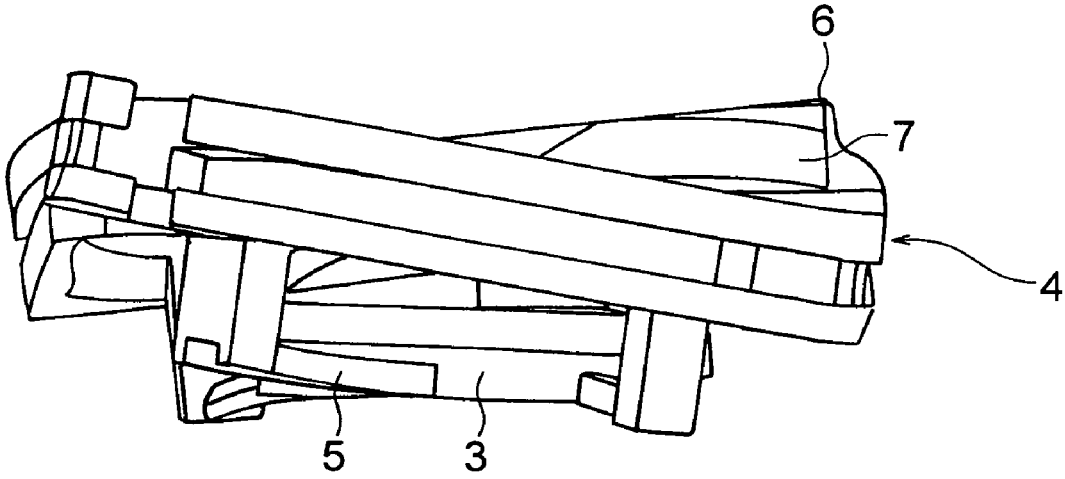
FIG. 5 illustrates a torsional mode out of the natural vibration modes of the venturi portion in an axial flow fan embodying the invention.
Figure 6:
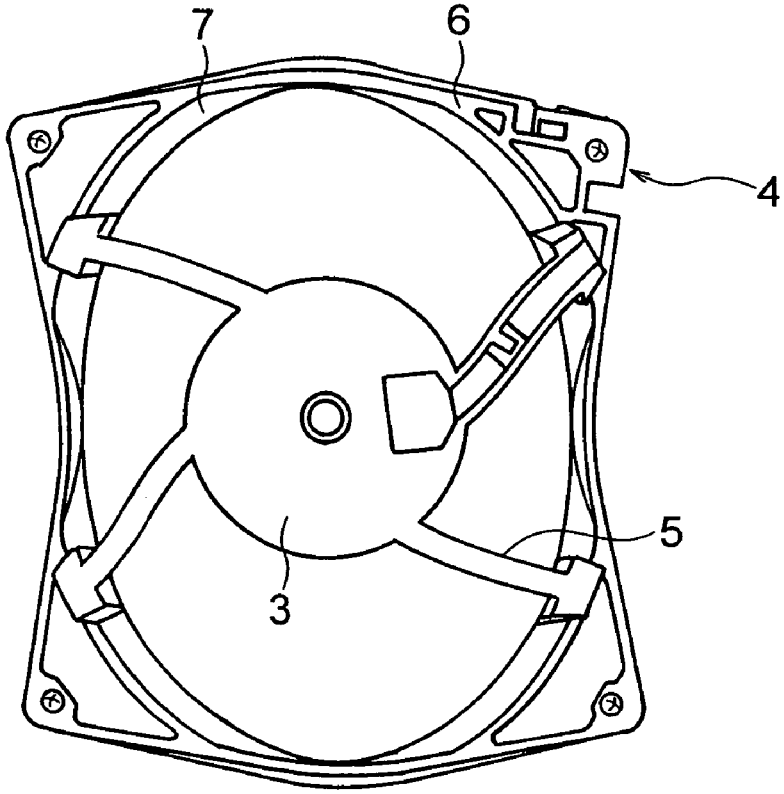
FIG. 6 illustrates the elliptic mode out of the natural vibration modes of the venturi portion in an axial flow fan embodying the invention.

Generally speaking, an axial flow fan particularly gives rise to a problem of vibration noise when the frequency of the electromagnetic exciting force of (by) the motor and the natural frequency of the venturi portion become equal to each other and thereby invite resonance. Whereas the venturi portion has many natural frequencies (natural vibration modes), what particularly contribute to the noise level of an axial flow fan are the torsional mode shown in FIG. 5 and the elliptic mode shown in FIG. 6.

Figure 7:
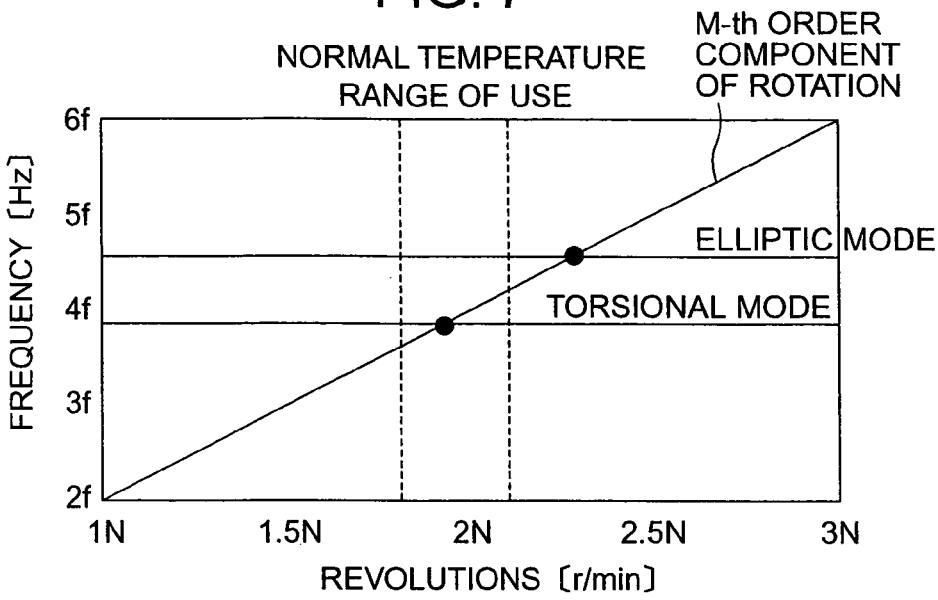
FIG. 7 is a graph showing a relationship between a rotational order component and the natural frequency of an axial flow fan of Comparative Example 1 when it is incorporated into a household electrical appliance (e.g. a refrigerator) (at normal temperature inside the refrigerator).

FIG. 7 is a graph showing the relationship between the rotational order component and the natural frequency of the axial flow fan of Comparative Example 1 when it is incorporated into a household electrical appliance (e.g. a refrigerator) (at normal temperature inside the refrigerator).

In this FIG. 7, the intersection point between the M-th order component of rotation and each of the aforementioned modes (the torsional mode and the elliptic mode) is the point of resonance. As the axial flow fan of Comparative Example 1 has intersection points in the rotational frequency range in which the fan is used, there is a possibility of resonance.

Figure 8:
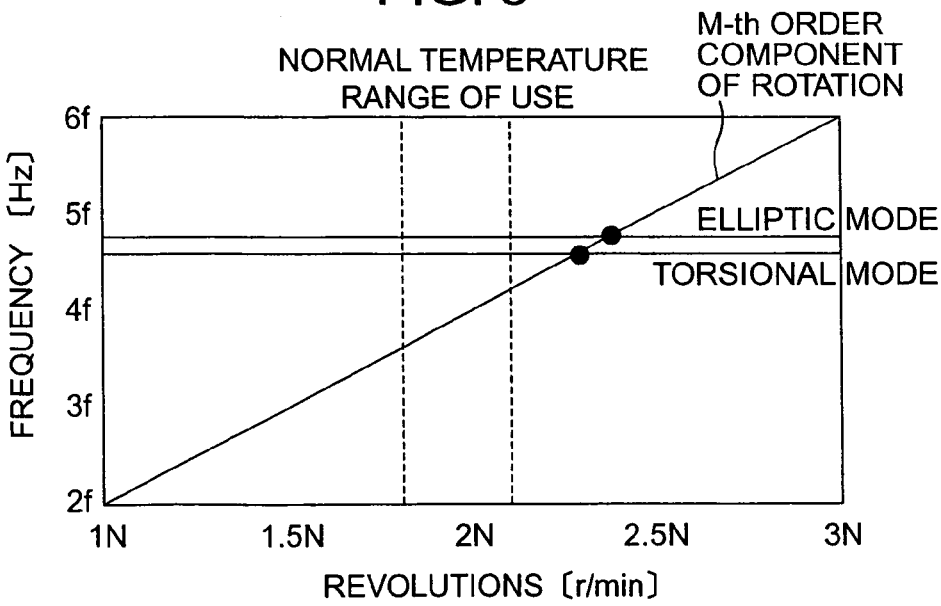
FIG. 8 is a graph showing a relationship between a rotational order component and the natural frequency of an axial flow fan embodying the invention when it is incorporated into a household electrical appliance (e.g. a refrigerator) (at normal temperature inside the refrigerator).

FIG. 8 is a graph showing the relationship between the rotational order components and the natural frequency (resonance frequency) of the axial flow fan according to the embodiment when it is incorporated into a household electrical appliance (e.g. a refrigerator) (at normal temperature inside the refrigerator).

As shown in this FIG. 8, the venturi portion 4 in the axial flow fan of the embodiment can be increased in rigidity as stated above, and this increase in rigidity raises the natural frequencies (natural vibration modes) of the venturi portion 4 with the result that its point of resonance rises above the rotational frequency range in which the fan is used and accordingly there is no longer a point of resonance in this range. Thus, a resonance-avoiding (anti-resonance) structure can be achieved. In this way, according to this embodiment, it is possible to avoid the phenomenon of resonance by increasing the rigidity of the venturi portion 4 and thereby to reduce the solid-conveyed noise (structure-borne noise) of the axial flow fan.

Furthermore, in the structure of Comparative Example 1, because the bellmouth has angular corners 13 and 14 as shown in FIG. 4, the air flow generated by the revolution of the propeller may be peeled off downstream from those angular corners 13 and 14 and invite a vortex flow, which could give rise to loud fluid noise. Unlike this, the bellmouth 7 of this embodiment can do away with the angular corner 13 by contracting the intake portion 10 in diameter in a curved shape in the direction of the air flow, and ease the angular corner 14 by reducing the angle of expansion of the discharge portion 12 to about 30°. Therefore, it is made difficult for the air flow to be peeled off in the bellmouth 7, resulting in restraint on the generation of vortex and accordingly in a reduction of fluid noise.

For the reasons described above, as compared with Comparative Example 1, the axial flow fan of the embodiment can reduce not only fluid noise but also solid-conveyed noise (structure-borne noise), resulting in a further overall cutback on noise.

Next, the effects of this embodiment will be described in comparison with Comparative Example 2.

Figure 9:
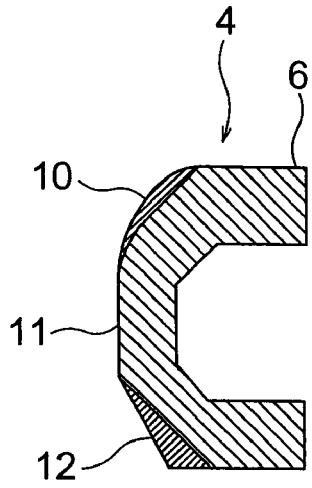
FIG. 9 is a sectional view comparatively illustrating the bellmouth shape of the axial flow fan embodying the invention and that of Comparative Example 2.

FIG. 9 is a sectional view comparatively illustrating the shapes of the bellmouth 7 of the axial flow fan of the embodiment and the bellmouth of Comparative Example 2. As shown in this FIG. 9, the use of the structure of the bellmouth 7 of this embodiment would expand the volume of the bellmouth 7 by the finer hatched parts in the drawing compared with the structure of Comparative Example 2. This can increase the rigidity of the venturi tube 4, thereby making it possible to avoid the phenomenon of resonance and to reduce the solid-conveyed noise (structure-borne noise) of the axial flow fan.

Furthermore, the structure of the bellmouth 7 of this embodiment can serve to improve aerodynamic characteristics as compared with the bellmouth structure of Comparative Example 2. This point will be described in further detail below.

Figure 10:
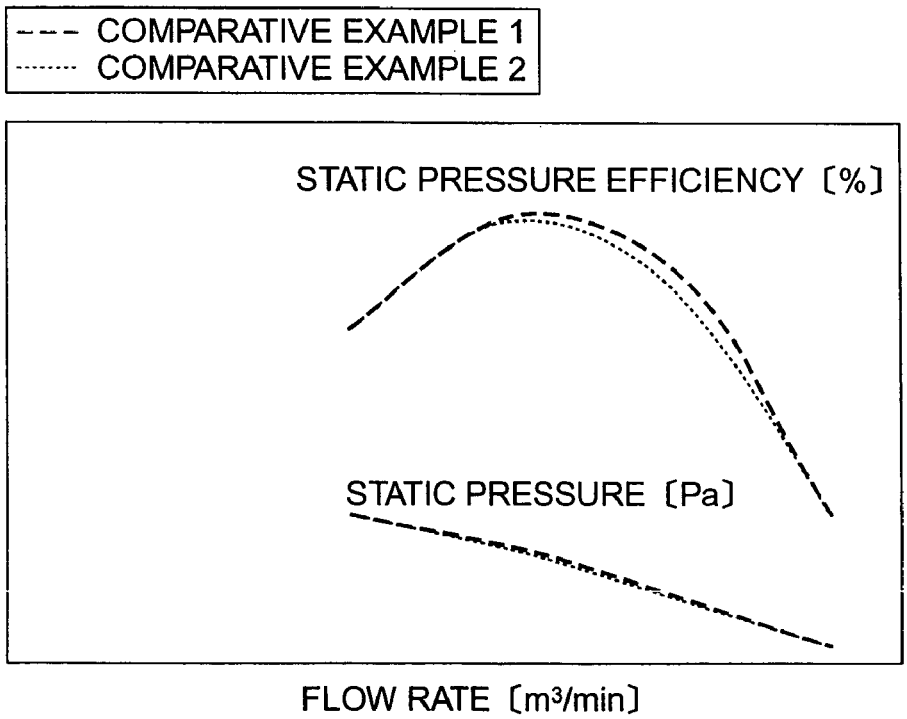
FIG. 10 shows results of analysis in the aerodynamic characteristics of Comparative Example 1 and of Comparative Example 2.

FIG. 10 shows the results of analysis of the aerodynamic characteristics of Comparative Example 2 and of Comparative Example 1 described above. The relationships between each of the static pressure and static pressure efficiency (the ratio of the static pressure work of the fan to the motor output) and the air flow rate are indicated in this graph. As shown in this FIG. 10, Comparative Example 2 is lower in static pressure efficiency than Comparative Example 1. This presumably can be explained by the dominance, in terms of the impact on aerodynamic characteristics, of the increase in (the) tip clearance (length), i.e. the gap between the propeller tip and the bellmouth, over the loss reduced by the rounded corners. Therefore, in order to optimize the bellmouth shape, the tip clearance (length) is more essential than merely to round the corners.

In view of these findings, the bellmouth 7 of this embodiment is rounded on the intake side with a tip clearance about equal to that in Comparative Example 1 secured with the cylindrical portion 11, as shown in FIG. 3 earlier, to contract the intake portion 10 in diameter in a curved shape in the direction of the air flow, and on the discharge side the discharge portion 12 is slantingly expanded at an angle of about 30°.

Figure 11:
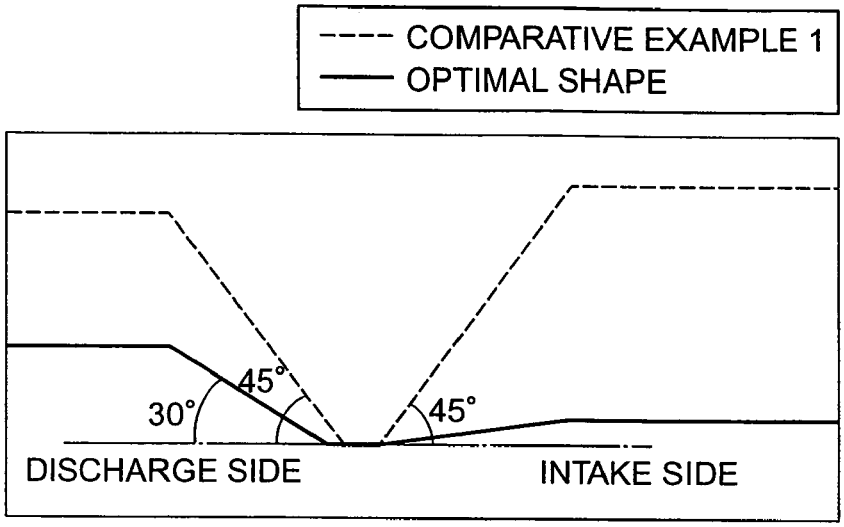
FIG. 11 comparatively illustrates the optimal shape of the bellmouth selected by optimization analysis and the bellmouth shape of Comparative Example 1.
Figure 12:
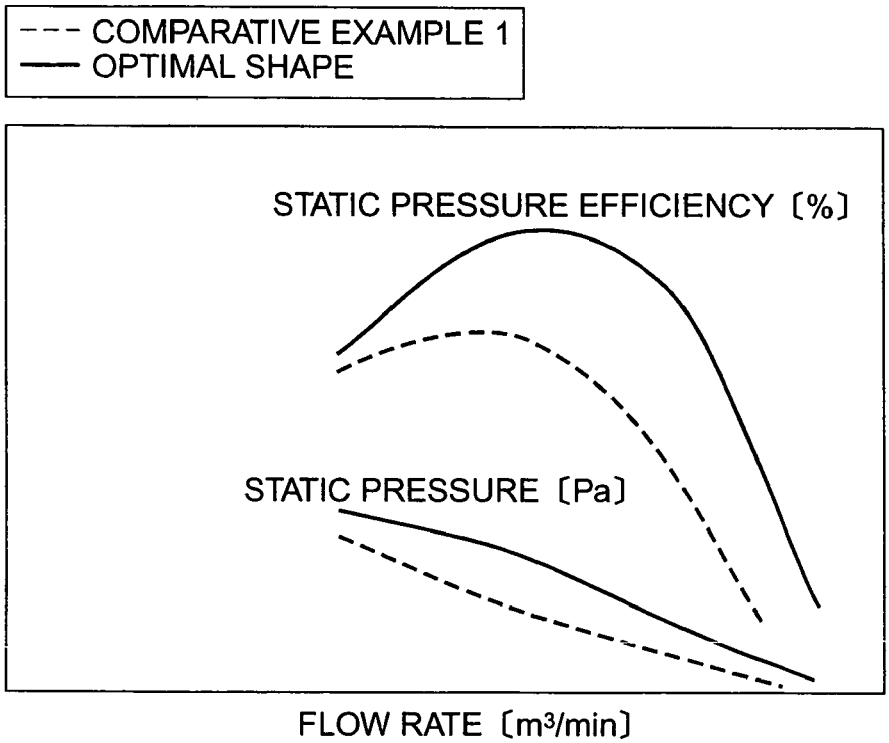
FIG. 12 comparatively illustrates the optimal shape and the aerodynamic characteristics of Comparative Example 1.

This 30° expanding angle of the discharge portion 12 was determined on the basis of the analysis of aerodynamic characteristics for optimization as shown in FIG. 11 and FIG. 12. FIG. 11 comparatively illustrates the optimal shape of the bellmouth selected by optimization analysis and the bellmouth shape of Comparative Example 1 which shows better aerodynamic characteristics than that of Comparative Example 2 as stated above. FIG. 12 comparatively illustrates the aerodynamic characteristics of the above optimal shape and Comparative Example 1. As these FIG. 11 and FIG. 12 reveal, the bellmouth of the optimal shape which can enhance the static pressure efficiency for Comparative Example 1 in the whole flow region has almost no inclination on the intake side, and the expansion angle on the discharge side is about 30°, smaller than the 45° expansion angle of Comparative Example 1. Accordingly, the expansion angle of the discharge portion 12 of the bellmouth 7 of this embodiment is made approximately 30° on the basis of the findings of this analysis.

As so far described, the structure of the bellmouth 7 of this embodiment is likely to provide an improvement in aerodynamic characteristics (static pressure efficiency) over Comparative Example 2 (and over the earlier-described Comparative Example 1 as well).

The foregoing description reveals that the axial flow fan of the embodiment is reduced in the noise level, as compared with Comparative Example 2, having the bellmouth shape equivalent to the conventional structure described in JP-A-2002-267319, by suppressing solid-conveyed noise (structure-borne noise) and, furthermore, can improve aerodynamic characteristics (static pressure efficiency).

To add, the axial flow fan of the embodiment also has a superiority over Comparative Example 2 regarding the fabrication of the venturi portion. Thus, generally in fabricating an axial flow fan like this embodiment, the intake portion 10, the cylindrical portion 11 and the discharge portion 12 of the venturi portion 4 are usually fabricated separately and later put together integrally. In this process, for Comparative Example 2 whose joint parts constitute a continuous curved face, considerable care should be taken not to allow discontinuous level gaps to occur in assembling. Unlike that, the axial flow fan of the embodiment requires no such attention because its joint parts are essentially discontinuous corners (see FIG. 4). Therefore, the structure of the bellmouth 7 of this embodiment can be regarded as being better suited to the circumstances of venturi portion fabrication than that of Comparative Example 2.

Another feature of the axial flow fan of the embodiment consists in the fitting direction of its legs (spiders) 5.

Figure 13:
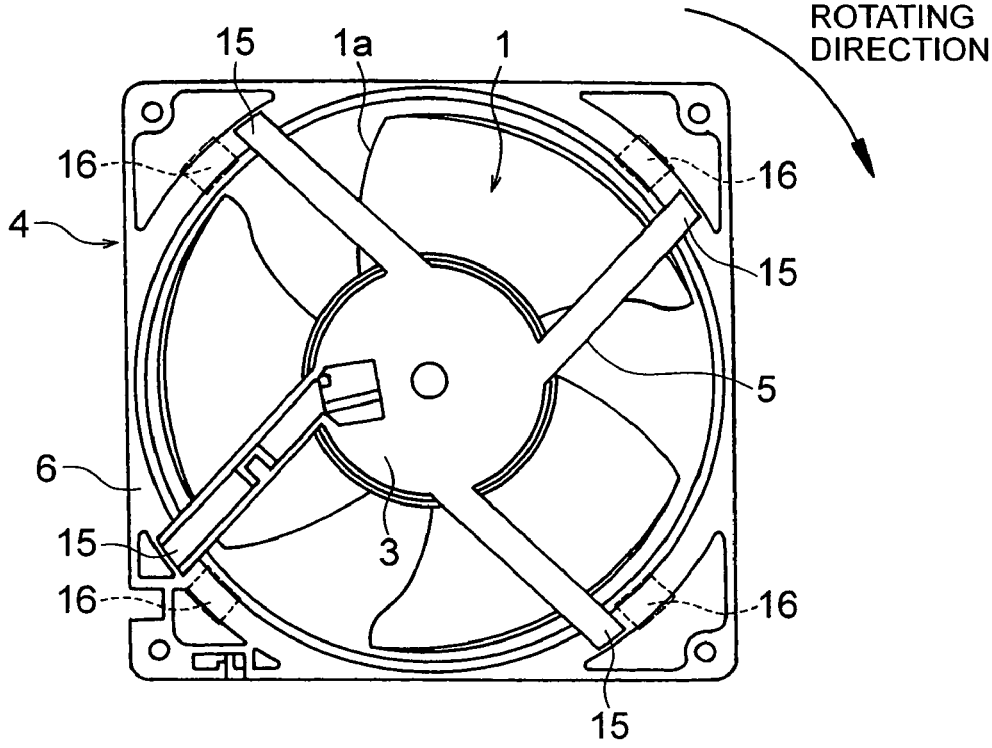
FIG. 13 shows a plan of the overall structure of the axial flow fan embodying the invention.

FIG. 13 shows a plan view of the overall structure of the axial flow fan of the embodiment according to the invention (as viewed from the discharge side) in more detail than FIG. 2 referred to earlier. As shown in this FIG. 13, the legs (spiders) 5 are fitted not in parallel to the trailing edge 1*a* of the propeller 1 but to cross it asymptotically at a certain angle. This arrangement is used because in a structure that the legs (spiders) 5 are in parallel to the trailing edge 1*a* of the propeller 1, the shapes of the trailing edge 1*a* and the legs (spiders) 5 would substantially overlap each other when the trailing edge 1*a* of the propeller 1 passes the legs (spiders) 5, possibly inviting major pressure variations around the legs (spiders) 5 and accordingly an increase in fluid noise. In this embodiment, as the above-described structure serves to narrow the overlapping parts (asymptotically intersecting parts) of the legs (spiders) 5 and the trailing edge 1*a* of the propeller 1 (that intersection point shifts from the outer circumferential side in the radial direction toward the inner circumferential side when the propeller 1 is revolving), interference between the legs (spiders) 5 and the trailing edge 1*a* is eased, making it possible to reduce fluid noise.

Still another feature of the axial flow fan of the embodiment consists in the fitting position of the legs (spiders) 5.

As shown in FIG. 13 referred to above, the joint parts 15 between the legs (spiders) 5 and the venturi portion 4 (the outer frame 6) in the axial flow fan of the embodiment are positioned near padded parts 16 in the four corners of the outer frame 6 of the venturi portion 4. In further detail, they are arranged somewhat downstream from the padded parts 16 in the revolving direction of the propeller 1. These padded parts 16 are generated in fabricating the venturi portion 4 on account of unmolding circumstances.

Figure 14:
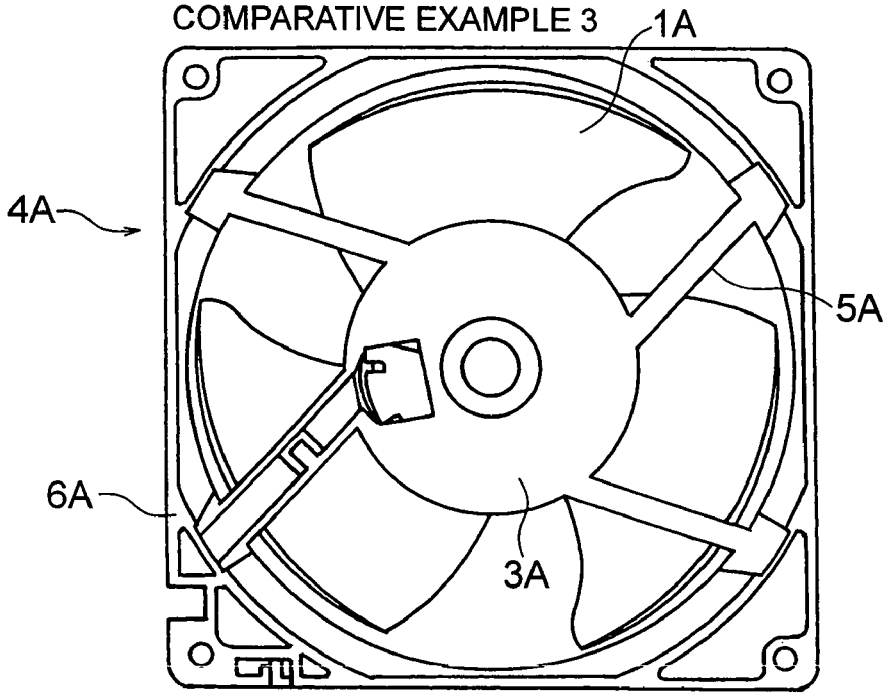
FIG. 14 shows a plan view of the overall structure in the axial flow fan of Comparative Example 3.

The benefits provided by this structure will be described below in comparison with Comparative Example 3. FIG. 14 shows a plan view of the overall structure of the axial flow fan of Comparative Example 3.

As shown in this FIG. 14, the legs (spiders) structure of the axial flow fan of Comparative Example 3 is such that two each of legs (spiders) 5A are fitted to only the right and left sides, as illustrated in FIG. 14, of an outer frame 6A of a venturi portion 4A but not on the top and bottom sides.

Generally, in an axial flow fan, an electromagnetic exciting force generated by cogging torque (which means so-called uneven torque, varying relative to the angle of torque rotation due to a magnetic absorptive force generating between the stator and the rotor of the motor 2) and the passage of the propeller 1 conveys from the plate 3 to the outer frame 6 of the venturi portion 4 through the legs (spiders) 5. A key factor for reducing the vibration response of the venturi portion 4 is how to make the structure obstructive to the transmission of vibration on the conveying path.

In the structure of Comparative Example 3, since the electromagnetic exciting force transmitted via the legs (spiders) 5A conveys only to the right and left sides of the outer frame 6A of the venturi portion 4A as described above, the propagation is made uneven. Furthermore, as the venturi portion 4A is supported in the right and left fitting positions, the top and bottom sides of the outer frame 6A almost freely allow vibration, and presumably become easily vibratory both in the axial direction and in the radial direction. Incidentally, the typical vibration modes of the venturi portion 4A in the axial direction and in the radial direction are respectively the torsional mode and the elliptic mode earlier shown in FIG. 5 and FIG. 6.

By contrast, in the axial flow fan of the embodiment, the joint parts 15 between the legs (spiders) 5 and the outer frame 6 of the venturi portion 4 are equally arranged on the top, bottom, right and left sides of the outer frame 6 as shown in FIG. 13. The unevenness of the conveyed vibration is thereby eliminated, and the up-and-down vibration of the venturi portion 4 can be reduced. Further in this embodiment, as the joint parts 15 are arranged in the vicinities of the relatively strong padded parts 16, the conveyed vibration from the legs (spiders) 5 to the outer frame 6 can be reduced even more.

Figure 15:
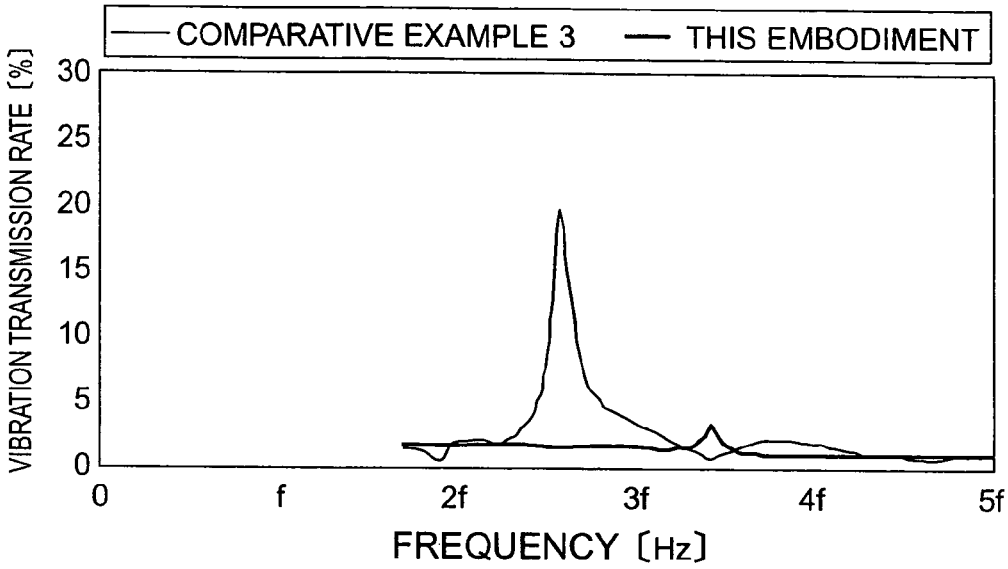
FIG. 15 comparatively illustrates vibration transmission rates of plates and leg roots in the axial flow fan embodying the invention and in Comparative Example 3.
Figure 16:
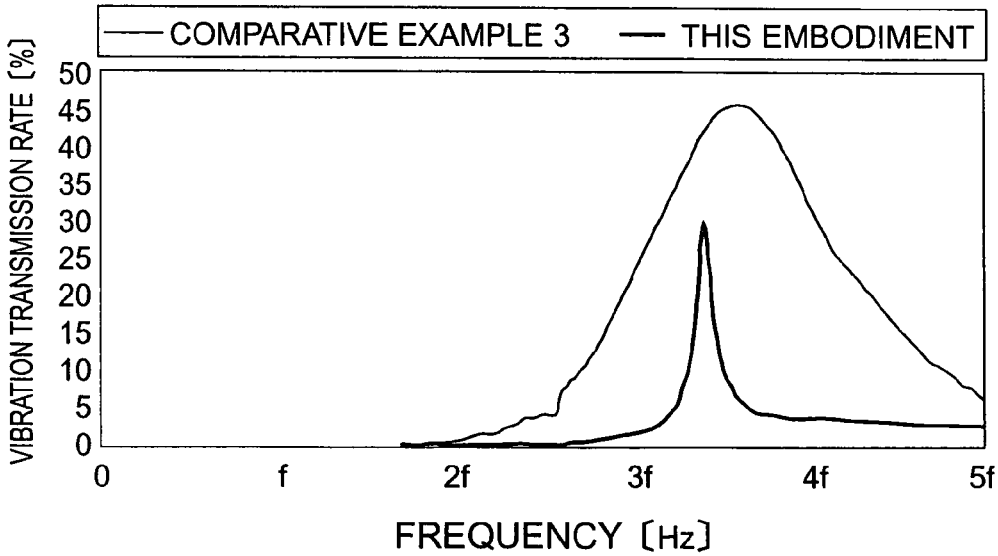
FIG. 16 comparatively illustrates the vibration transmission rates of leg (spiders) roots and the central part of the outer frame in the axial flow fan embodying the invention and Comparative Example 3.

These effects to reduce the conveyed vibration will now be described with reference to FIG. 15 and FIG. 16. FIG. 15 comparatively illustrates the vibration transmission rates of plates and leg roots (the roots at spider's part) in Comparative Example 3 and in the axial flow fan of the embodiment. It is seen from this FIG. 15 that the vibration transmission rate is reduced in this embodiment to about 1/7 as compared with Comparative Example 3. FIG. 16 comparatively illustrates the vibration transmission rates of leg roots (the roots at spider's part) and the central part of the outer frame in Comparative Example 3 and the axial flow fan of the embodiment. It is seen from FIG. 13 that the vibration transmission rate is reduced in this embodiment to about 2/3 as compared with Comparative Example 3.

As hitherto described, the axial flow fan of the embodiment allows a further reduction in fluid noise by improving the shape of the bellmouth 7 and the installing direction of the legs (spiders) 5. It is also enabled to avoid the phenomenon of resonance by increasing the rigidity of the venturi portion 4, and to lower the solid-conveyed noise (structure-borne noise) of the axial flow fan by fitting the legs (spiders) 5 in the vicinities of the padded parts 16 and thereby reducing the vibration transmission rate. Therefore, noise can be reduced beyond the level of the aforementioned examples of the related earlier art which focus merely on reducing fluid noise.

To add, the axial flow fan of the embodiment can be effectively applied to electrical household appliances needing refrigeration or cooling such as refrigerators and television sets, various equipment for office automation and information technology (IT) items including computers, word processors (personal computers) and copying machines. One example is shown in FIG. 17.

Figure 17:
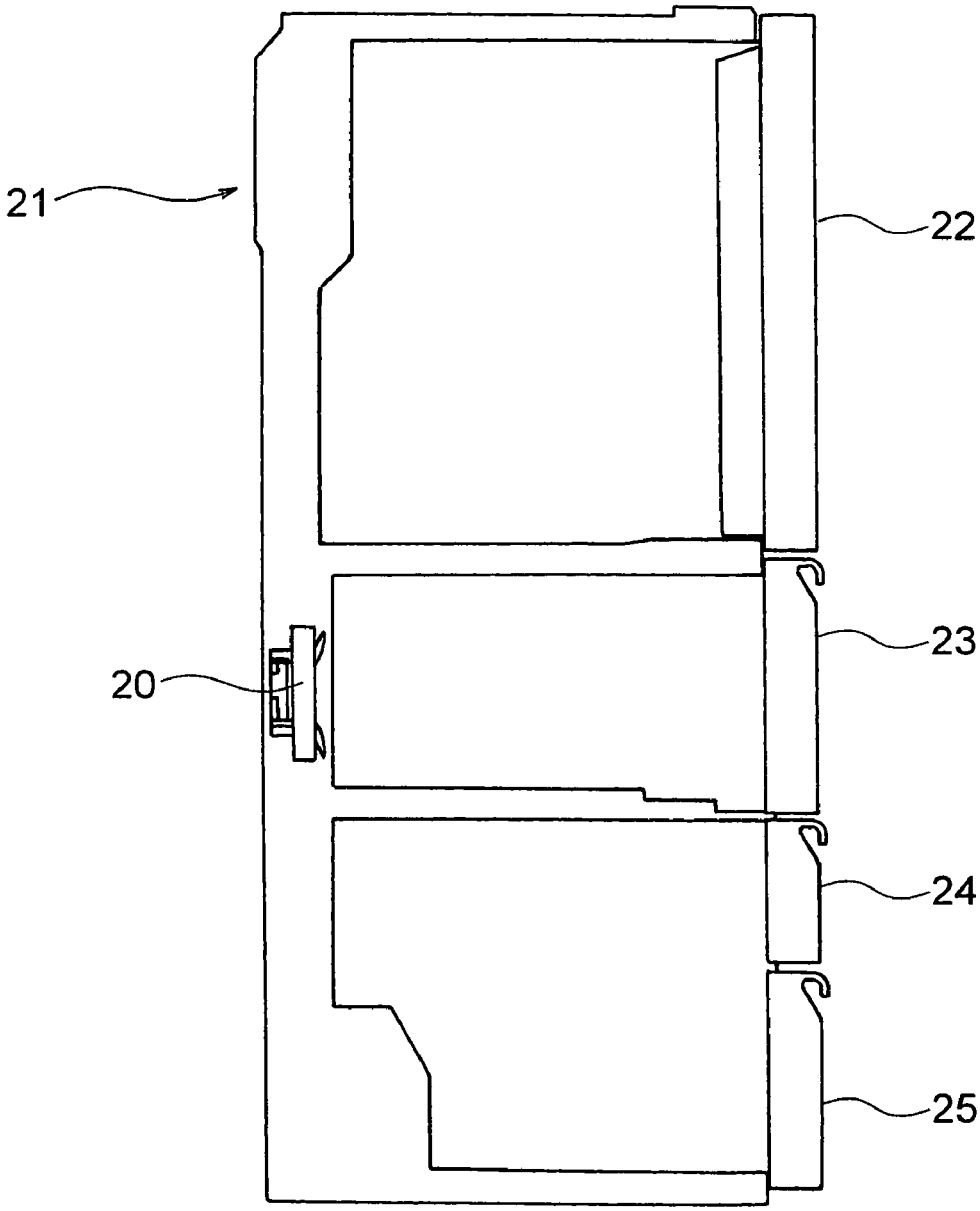
FIG. 17 shows a section view of the overall structure of a refrigerator fitted with the axial flow fan embodying the invention.

FIG. 17 is a section view of the overall structure of a refrigerator 21 fitted with the axial flow fan of the embodiment (wherein the axial flow fan is denoted by reference numeral 20). As shown in this FIG. 17, the axial flow fan 20 is installed in a prescribed position in the refrigerator 21. A buffer member (not shown) made of urethane or the like is wound around the venturi portion 4 of the axial flow fan 20 installed here.

Generally, the cooling fan in a refrigerator may or may not stop operation when any of drawers or doors 22 through 25 is opened, but the latter case is supposed in the following description. When any of the drawers or the doors 22 through 25 of the refrigerator 21 is opened, the noise of the axial flow fan 20 will become audible by the user. Therefore, reducing the noise of the axial flow fan 20 is an important requirement in creating a pleasant environment around the refrigerator 21.

Figure 18:
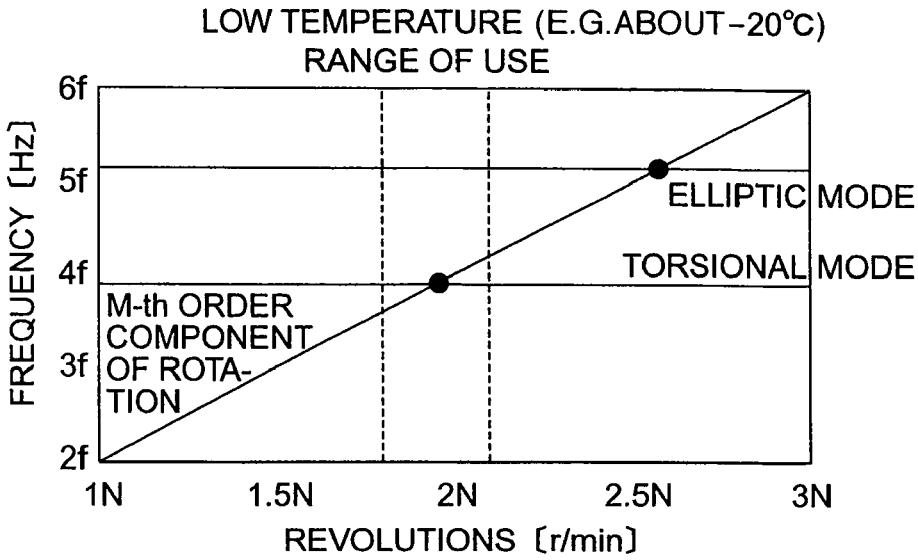
FIG. 18 is a graph showing a relationship between a rotational order component (element) and a natural frequency of the axial flow fan of Comparative Example 1 when it is incorporated into a refrigerator whose inside temperature is low (e.g. about −20°).
Figure 19:
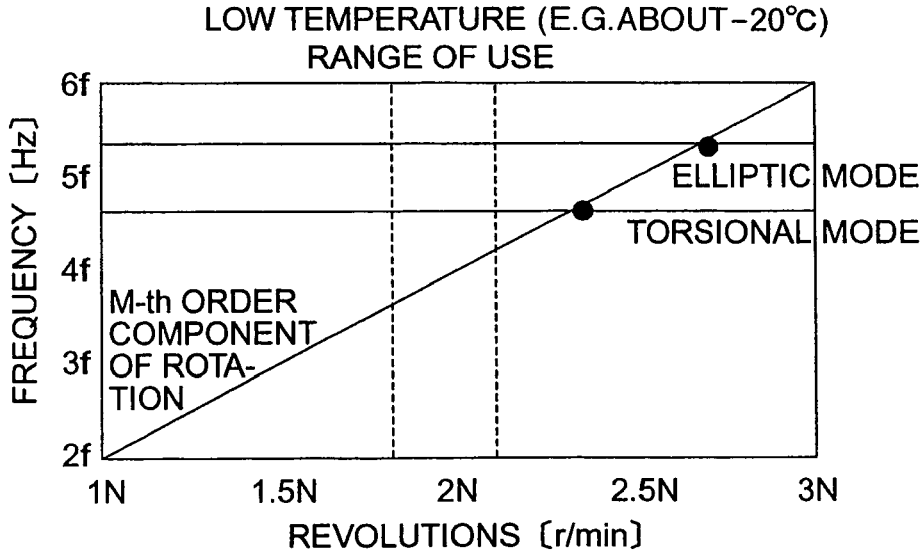
FIG. 19 is a graph showing a relationship between a rotational order component (element) and a natural frequency of the axial flow fan embodying the invention when it is incorporated into a refrigerator whose inside temperature is low (e.g. about −20° C.).

Now, FIG. 18 is a graph showing the relationship between the rotational order component and the natural frequency of the axial flow fan of Comparative Example 1 described above when it is incorporated into a refrigerator whose inside temperature is low (e.g. about −20° C.). FIG. 19 is a graph showing the relationship between the rotational order component and the natural frequency of the axial flow fan of the embodiment when it is incorporated into a refrigerator whose inside temperature is low (e.g. about −20° C.).

As these FIG. 18 and FIG. 19 show, while the axial flow fan of Comparative Example 1 may resonate because it has an intersection point in the rotational frequency range in which the fan is used, the axial flow fan 20 of the embodiment can be built as a resonance avoiding (anti-resonance) structure, even if the ambient temperature is low (e.g. −20° C.), by keeping the point of resonance above the rotational frequency range in which the fan is used. Though not described in detail here with reference to any drawing, the vibration transmission rate can be reduced, too, and so can be fluid noise, both in the same way as described above. Since the axial flow fan 20 can reduce noise including solid-conveyed noise (structure-bone noise) and fluid noise in this way, the refrigerator 21 equipped with this axial flow fan 20 can provide its user with a low-noise pleasant environment.

It should be further understood by those skilled in the art that the foregoing description has been made on embodiments of the invention and that various changes and modifications may be made in the invention without departing from the spirit of the invention and the scope of the appended claims.

The invention claimed is:

1. An axial flow fan comprising:

a propeller, an electric motor for driving said propeller, and a venturi portion disposed on an outer circumference of said propeller and provided on its inner circumferential side with a bellmouth through which an air flow generated by the revolution of said propeller passes, wherein said bellmouth has an intake portion whose diameter contracts in a curved shape in the direction of said air flow, a cylindrical portion having a cylindrical shape, and a discharge portion whose diameter slantingly expands in the direction of said air flow, and wherein the inner circumferential side of said venturi portion has a height which is smaller than a height of an outer circumferential side of said propeller.

2. An axial flow fan, as claimed in claim 1, further provided with legs to link an electric motor supporting part for supporting said electric motor and said venturi portion and so arranged as to cross a trailing edge of said propeller asymptotically at a certain angle.

3. An axial flow fan, as claimed in claim 2, wherein said venturi portion has padded parts in four corners, and joint parts between said legs and said venturi portion is arranged in the vicinities of said padded parts.

4. An axial flow fan, as claimed in claim 3, wherein said joint parts are arranged downstream from said padded parts in the revolving direction of said propeller.

5. An axial flow fan, as claimed in claim 1, wherein the expanding angle of said discharge portion is approximately 30°.

6. A refrigerator equipped with an axial flow fan claimed in claim 1.

7. A household electrical appliance equipped with an axial flow fan claimed in claim 1.

8. An axial flow fan, as claimed in claim 1, further comprising:

legs to link an electric motor supporting part for supporting said electric motor and said venturi portion;

wherein each of the legs has an L shape cross section comprising a vertical part which extends from a bottom of said venturi portion toward the direction of air flow at the intake portion of said venturi portion, and a transverse part which extends from the vertical part toward the electric motor supporting part.

9. An axial flow fan, as claimed in claim 8, wherein said venturi portion has a plurality of bottom sides, and wherein each of the bottom sides is connected by at least one of the legs.

* * * * *